US009375940B2

(12) United States Patent
Denda et al.

(10) Patent No.: US 9,375,940 B2
(45) Date of Patent: Jun. 28, 2016

(54) INK ACCOMMODATION BODY, INK ACCOMMODATION BODY SET, AND BUNDLING BODY

(71) Applicant: Seiko Epson Corporation, Tokyo (JP)

(72) Inventors: Atsushi Denda, Chino (JP); Shoki Kasahara, Mobara (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/474,589

(22) Filed: Sep. 2, 2014

(65) Prior Publication Data

US 2015/0062264 A1 Mar. 5, 2015

(30) Foreign Application Priority Data

Sep. 2, 2013 (JP) ..... 2013-181144

(51) Int. Cl.
*B41J 2/175* (2006.01)
*B41J 2/19* (2006.01)

(52) U.S. Cl.
CPC ..... *B41J 2/17553* (2013.01); *B41J 2/17513* (2013.01); *B41J 2/17536* (2013.01)

(58) Field of Classification Search
None
See application file for complete search history.

(56) References Cited

U.S. PATENT DOCUMENTS

| | | | | |
|---|---|---|---|---|
| 5,798,147 | A * | 8/1998 | Beck et al. | 427/511 |
| 6,325,500 | B1 * | 12/2001 | Kitabatake et al. | 347/86 |
| 2003/0170411 | A1 * | 9/2003 | Eida et al. | 428/35.7 |
| 2004/0174418 | A1 | 9/2004 | Toba et al. | |
| 2007/0242115 | A1 * | 10/2007 | Ishizawa et al. | 347/86 |
| 2009/0102902 | A1 | 4/2009 | Nose et al. | |
| 2010/0256284 | A1 | 10/2010 | Kagata et al. | |

FOREIGN PATENT DOCUMENTS

| | | | |
|---|---|---|---|
| JP | 2008-189003 | A | 8/2008 |
| JP | 2009-101597 | A | 5/2009 |
| JP | 2011-132483 | A | 7/2011 |

* cited by examiner

*Primary Examiner* — Erica Lin
(74) *Attorney, Agent, or Firm* — Harness, Dickey & Pierce, P.L.C.

(57) ABSTRACT

An ink accommodation body according to the invention is detachably attached to an ink jet recording apparatus, and is packaged with a package body, the ink accommodation body includes an ink accommodation portion that accommodates ink containing a base metal pigment; and an atmosphere opening portion that is connected to the ink accommodation portion at one end, and communicates with an atmosphere, and a hydrogen gas transmission rate of the package body is equal to or greater than 0.0001 ml/cm$^2$·day·atm and equal to or less than 0.01 ml/cm$^2$·day·atm.

15 Claims, 11 Drawing Sheets

INK ACCOMMODATION BODY, INK ACCOMMODATION BODY SET, AND BUNDLING BODY

BACKGROUND

1. Technical Field

The present invention relates to an ink accommodation body, an ink accommodation body set, and a bundling body that bundles the same.

2. Related Art

In the related art, an ink jet recording apparatus that records an image or the like on a recording medium by fine ink drops discharged from the nozzles of a recording head for ink jet recording is known. In the ink jet recording apparatus, an ink accommodation body (for example, an ink cartridge) for supplying ink to the recording head is detachably mounted.

For example, an ink cartridge that is connected to an ink jet printer to be used is disclosed in JPA-2008-189003 and JP-A-2009-101597. Specifically, the corresponding ink cartridge is provided with an ink accommodation chamber that accommodates ink, a liquid supplying portion (ink supplying portion) that supplies the ink to the ink jet printer, an atmosphere opening hole (communication portion) for appropriately maintaining an internal pressure by causing the inside of the ink cartridge and the atmosphere to communicate with each other, and the like.

Meanwhile, as ink for ink jet recording, the development of ink including a metal pigment such as aluminum has progressed, in addition to color ink using a coloring material such as a general dye and a general pigment. In the ink including such a pigment, from the viewpoint of safety for the environment for humans, the current situation is such that the development of aqueous ink including an aqueous medium such as water as a base material is more desirable than nonaqueous ink including an organic solvent as a base material. However, if the metal pigment is dispersed in water, the surface of the metal pigment is deteriorated or exhausted by reaction with water and damages metallic luster in some cases.

For example, ink obtained by dispersing a water resistant aluminum pigment obtained by covering a surface of an aluminum pigment with a covering film of silica or the like in an aqueous medium is disclosed in JP-A-2011-132483. However, even if a pigment obtained by covering the surface of a metal pigment with a covering film is used, the covering is not sufficient, and the reaction with water is not sufficiently prevented. Otherwise, if a covering film is removed as time passes or the ink cartridge is exposed to the high temperature for a long time (for example, the ink cartridge is left in a car in summer for a long time), the metal pigment reacts with water so that gas (for example, hydrogen gas) is generated.

The ink cartridge may be packaged with a package body such as a film. The package body is used for the purpose of maintaining the deaeration state of the ink accommodated in the ink cartridge, or protecting the ink cartridge from scratches, impacts, or the like when the ink cartridge 1 is transported or stored. Here, when the ink that generates gas by the reaction with water as described above is accommodated in the ink cartridge, even if the air generated from the ink is discharged to the outside of the ink cartridge, the gas stays between the ink cartridge and the package body, so that the package body is deformed or broken.

SUMMARY

An advantage of some aspects of the invention is to provide an ink accommodation body that can prevent a package body from being broken when the ink accommodation body that accommodates ink containing a base metal pigment is packaged by the package body.

The present invention can be realized in the following forms or application examples.

APPLICATION EXAMPLE 1

According to an aspect of the invention, there is provided an ink accommodation body that is detachably attached to an ink jet recording apparatus, and is packaged with a package body, the ink accommodation body including an ink accommodation portion that accommodates ink containing a base metal pigment and an atmosphere opening portion that is connected to the ink accommodation portion at one end, and communicates with an atmosphere, in which a hydrogen gas transmission rate of the package body is equal to or greater than 0.0001 $ml/cm^2 \cdot day \cdot atm$ and equal to or less than 0.01 $ml/cm^2 \cdot day \cdot atm$.

The ink accommodation body according to Application Example 1 can prevent the package body from being broken when an ink accommodation body that accommodates the ink containing the base metal pigment is packaged by the package body.

APPLICATION EXAMPLE 2

In the ink accommodation body according to Application Example 1, the other end of the atmosphere opening portion may be provided with an atmosphere opening hole that communicates with an outside of the ink accommodation body, the atmosphere opening hole may be sealed by a sealing member, and when a product of a hydrogen gas transmission rate of the sealing member and a size of a portion of the sealing member that covers the atmosphere opening hole is set to be A and a product of a hydrogen gas transmission rate of the package body and a surface area of the package body is set to be B, a relationship of $A<B$ may be satisfied.

APPLICATION EXAMPLE 3

In the ink accommodation body according to Application Example 2, a hydrogen gas transmission rate of a member existing between an inside of the ink accommodation portion or an inside of the atmosphere opening portion, and a surface of the ink accommodation body may be lower than a hydrogen gas transmission rate of the sealing member, and a vapor transmission amount of a member existing between an inside of the ink accommodation portion or an inside of the atmosphere opening portion, and a surface of the ink accommodation body may be lower than a water vapor transmission rate of the sealing member.

APPLICATION EXAMPLE 4

In the ink accommodation body according to any one of Application Examples 1 to 3, the package body may include a first region, and a second region having lower pressure tolerance than the first region.

APPLICATION EXAMPLE 5

In the ink accommodation body according to any one of Application Examples 2 to 4, the sealing member may include a first region and a second region having lower pressure tolerance than the first region.

APPLICATION EXAMPLE 6

According to another aspect of the invention, there is provided an ink accommodation body set including the ink accommodation body packaged with a package body according to any one of Application Examples 1 to 5; and a color ink accommodation body packaged with a package body, in which the color ink accommodation body includes an ink accommodation portion that accommodates color ink containing a coloring material other than the base metal pigment; and an atmosphere opening portion that is connected to the ink accommodation portion at one end, and communicates with an atmosphere.

APPLICATION EXAMPLE 7

In ink accommodation body set according to Application Example 6, a hydrogen gas transmission rate of the package body that packages the color ink accommodation body is lower than a hydrogen gas transmission rate of a package body that packages the ink accommodation body according to any one of Application Examples 1 to 5.

APPLICATION EXAMPLE 8

According to still another aspect of the invention, there is provided a bundling body including the ink accommodation body set according to Application Example 6 or in a housing that disposes and bundles the ink accommodation body accommodated in the package body according to any one of Application Examples 1 to 5 is disposed at an end portion of the housing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments appropriate for the invention are described as follows. The embodiments described below are examples of the invention. Further, the invention is not limited to the embodiments below, but includes various modification examples realized without departing from the gist of the invention. In addition, the entire configuration described in the embodiments below may not comprise the essential components of the invention.

1. Ink Accommodation Body

An ink accommodation body according to an embodiment of the invention is an ink accommodation body that can be attached to or detached from an ink jet recording apparatus, and packaged in a package body. The ink accommodation body includes an ink accommodation portion that accommodates ink containing a base metal pigment, and an atmosphere opening portion of which one end is connected to the ink accommodation portion to communicate with the atmosphere, and in which a hydrogen gas transmission rate of the package body is equal to or greater than 0.0001 $ml/cm^2 \cdot day \cdot atm$, and equal to or less than 0.01 $ml/cm^2 \cdot day \cdot atm$.

Hereinafter, the ink jet recording apparatus possibly mounted on the ink accommodation body according to the embodiment, the structure of the ink accommodation body, the characteristics of respective members, and inks accommodated in the ink accommodation body are described in detail in this sequence.

1.1. Ink Jet Recording Apparatus

The ink accommodation body according to the embodiment can be detachably mounted to the ink jet recording apparatus. When the ink accommodation body according to the embodiment is mounted on the ink jet recording apparatus, after the ink accommodation body is extracted from the package body described below, a sealing member (sealing film) that seals an atmosphere opening hole of the ink accommodation body and the like are removed.

Figure 1:
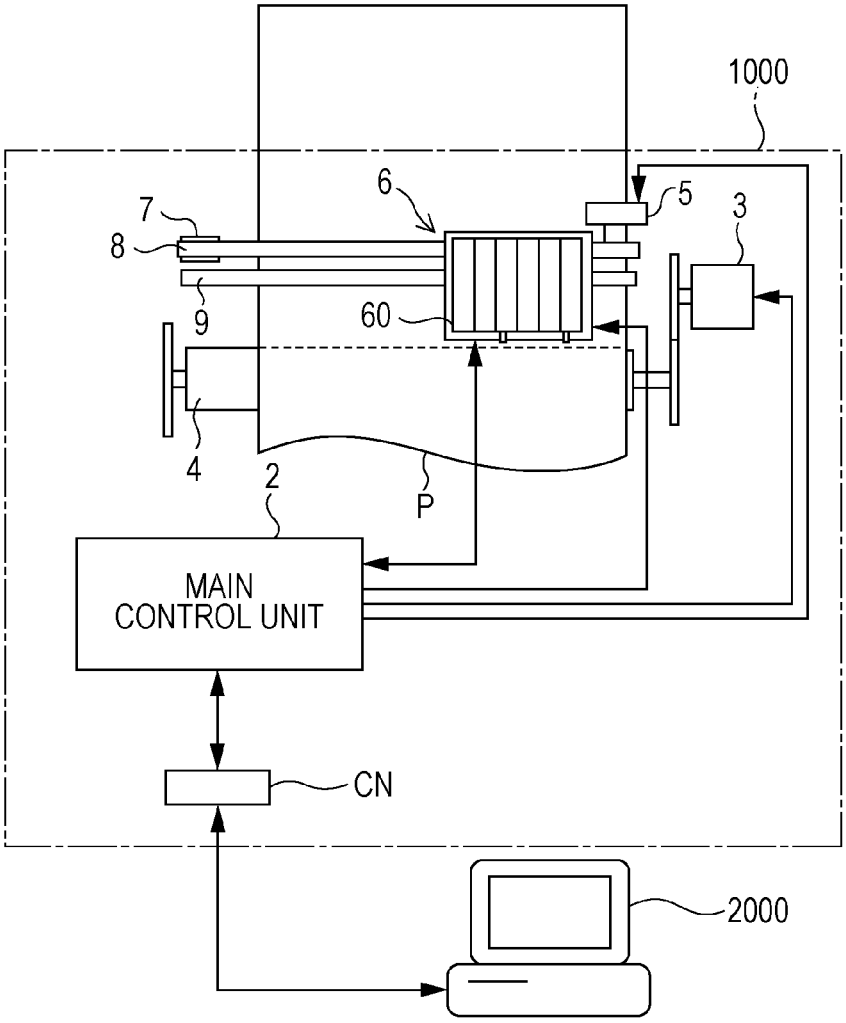
FIG. 1 is an explanatory diagram schematically illustrating a configuration of a recording system to which an ink accommodation body according to an embodiment is applied.
Figure 2:
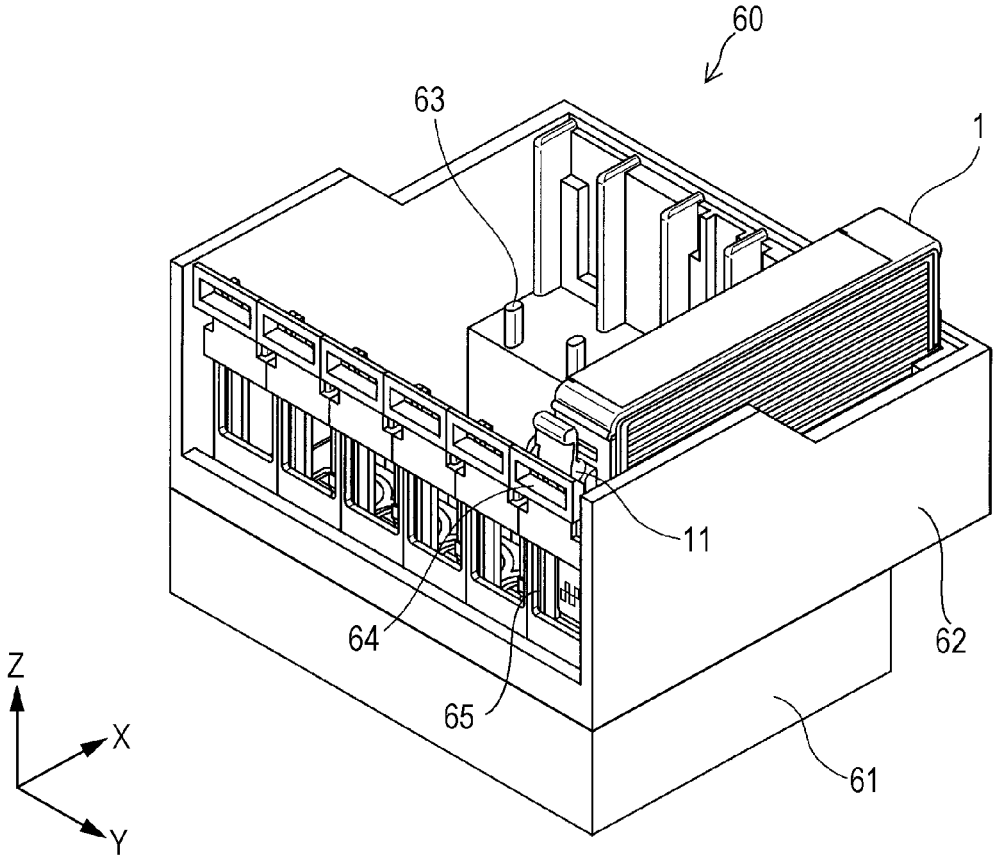
FIG. 2 is a diagram illustrating a state in which the ink accommodation body according to the embodiment is attached to a recording head unit.

Hereinafter, the configuration of ink jet printer (hereinafter, simply referred to as the "printer") which is an example of the ink jet recording apparatus that can be mounted on the ink accommodation body according to the embodiment is described with reference to FIGS. 1 and 2. FIG. 1 is an explanatory diagram schematically illustrating a configuration of a recording system. FIG. 2 is a diagram illustrating a state in which an ink cartridge 1 is mounted in the recording head unit. The ink cartridge 1 is an example of the ink accommodation body.

The recording system includes a printer 1000 and a computer 2000. The printer 1000 is connected to the computer 2000 through a connector CN. The printer 1000 includes a sub-scanning mechanism, a main scanning mechanism, a head driving mechanism, and a main control unit 2 for controlling respective mechanisms. The sub-scanning mechanism includes a paper feeding motor 3 and a platen 4, and transports paper P in the sub-scanning direction by transferring the rotation of the paper feeding motor to a platen. The main scanning mechanism includes a cartridge motor 5, a pulley 7, a driving belt 8 extending between the cartridge motor 5 and the pulley 7, and a sliding axis 9 provided in parallel to an axis of the platen 4. The sliding axis 9 is maintained so as to slide a carriage 6 fixed to the driving belt 8. The rotation of the cartridge motor 5 is transferred to the carriage 6 through the driving belt 8, and the carriage 6 reciprocates in the axial direction (main scanning direction) of the platen 4 along the sliding axis 9. The head driving mechanism includes a recording head unit 60 mounted on the carriage 6, and ejects ink onto the paper P by driving the recording head. A holder (not illustrated in FIG. 1) described below is disposed above the recording head unit 60 so that a plurality of ink cartridges can be detachably mounted thereto. Additionally, the printer 1000 includes an operation portion or the like so that the user can adjust various settings and check the status of the printer. In FIG. 1, an example of a so-called serial head type ink jet recording apparatus is illustrated, but the invention is not limited thereto. The ink jet recording apparatus according to the embodiment may be a line head type ink jet recording apparatus.

As illustrated in FIG. 2, the recording head unit 60 includes a recording head 61, and a holder 62 disposed on the upper surface of the recording head 61. The holder 62 is configured so that the plurality of ink cartridges 1 can be mounted thereon. Protrusions 63 and cavities 64 for determining the positions of the ink cartridges 1 and fixing the ink cartridges 1 at the positions are formed in the holder 62. The connection mechanism with contact pins (terminals) and carriage circuits are disposed on an opening portion 65 of the holder 62 in the X axis negative direction (not illustrated). Further, ink supply needles (described below) are disposed on the upper surface of the recording head 61.

1.2. Structure of Ink Accommodation Body

The structure of the ink cartridge which is an example of the ink accommodation body according to the embodiment is described in detail with reference to FIGS. 3 to 6.

Figure 3:
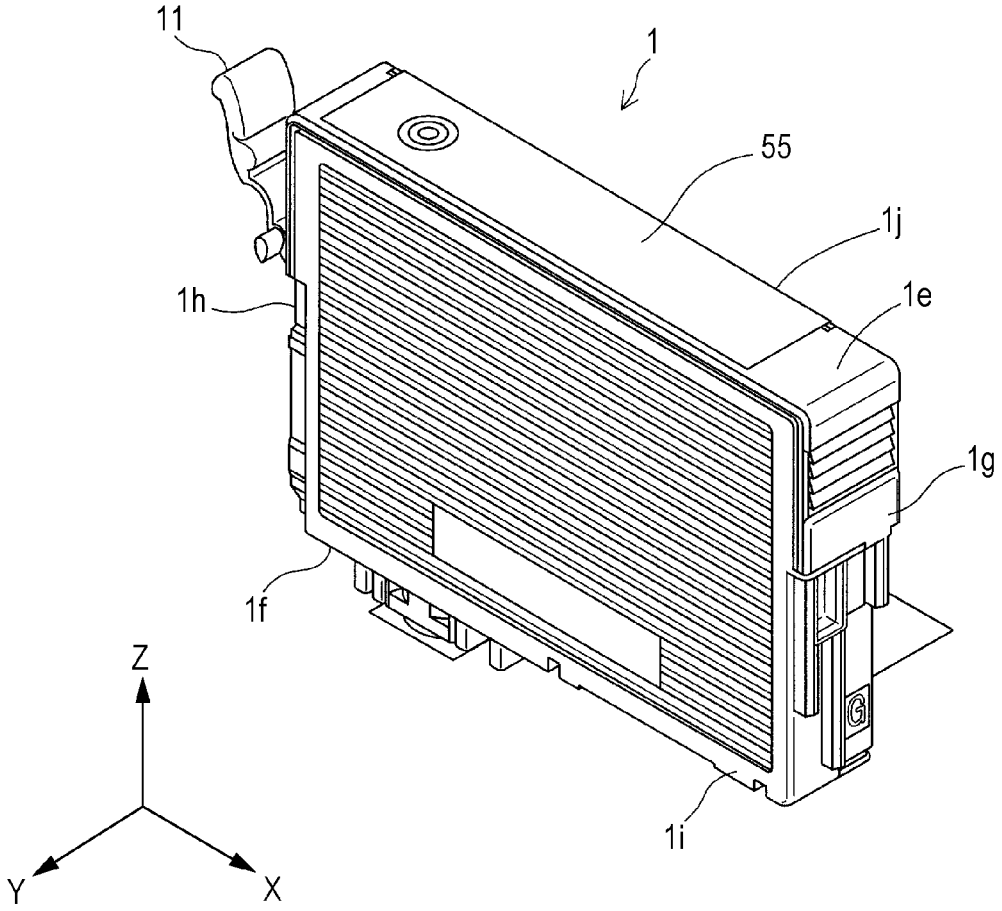
FIG. 3 is a first perspective view schematically illustrating the external appearance of the ink accommodation body according to the embodiment.
Figure 4:
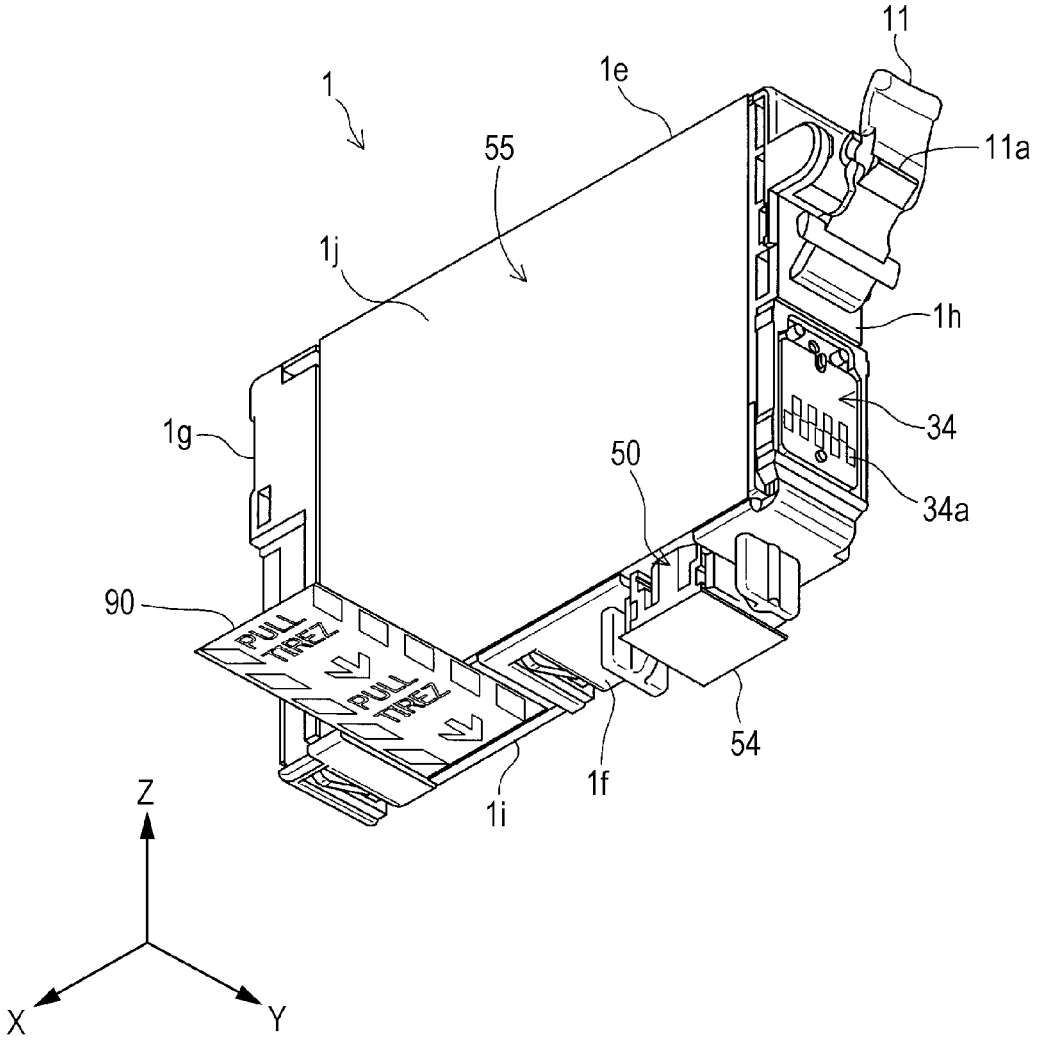
FIG. 4 is a second perspective view schematically illustrating the external appearance of the ink accommodation body according to the embodiment.
Figure 5:
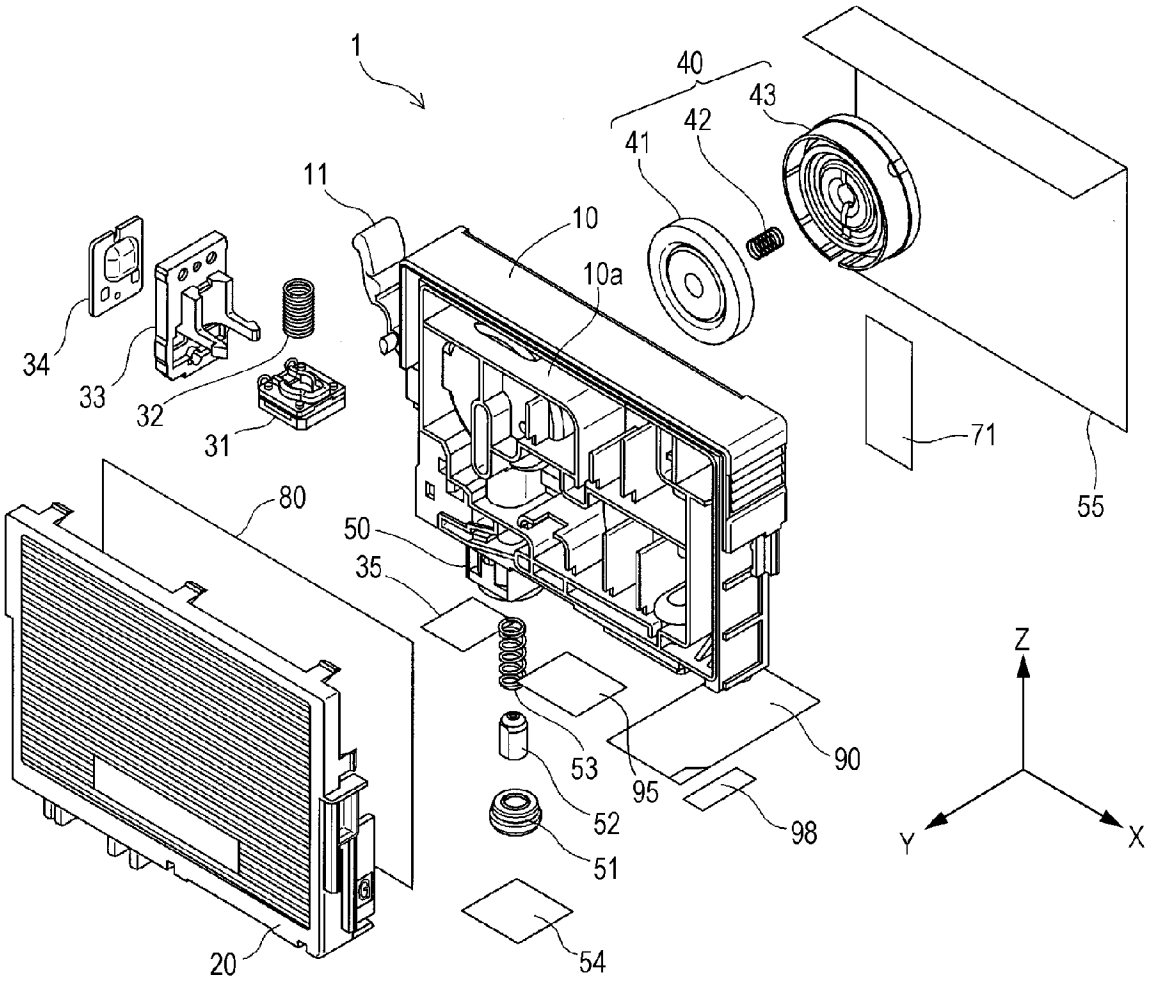
FIG. 5 is a first exploded perspective view schematically illustrating the ink accommodation body according to the embodiment.
Figure 6:
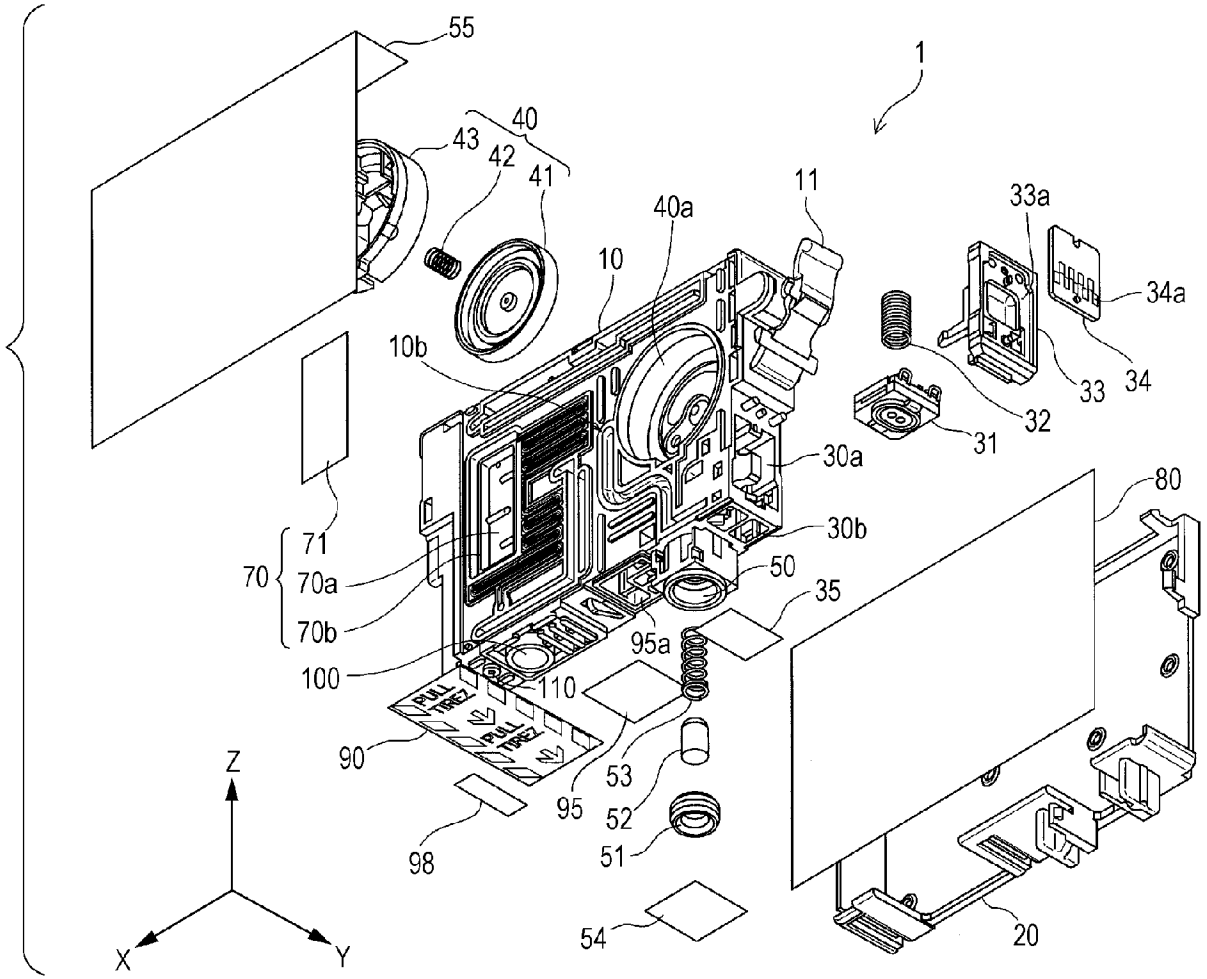
FIG. 6 is a second exploded perspective view schematically illustrating the ink accommodation body according to the embodiment.

FIG. 3 is a first perspective view illustrating the external appearance of the ink cartridge 1. FIG. 4 is a second perspective view illustrating the external appearance of the ink cartridge 1. FIG. 4 is a diagram illustrating the ink cartridge 1 of FIG. 3 seen in the opposite direction. FIG. 5 is a first exploded perspective view of the ink cartridge 1. FIG. 6 is a second exploded perspective view of the ink cartridge 1. FIG. 6 is a diagram illustrating the ink cartridge 1 of FIG. 5 seen in the opposite direction.

The ink cartridge 1 accommodates the ink containing the base metal pigment described below therein. When the ink cartridge 1 is mounted in the holder 62 as illustrated in FIG. 2, ink is supplied to the recording head 61 through the ink supply needles.

As illustrated in FIGS. 3 and 4, the ink cartridge 1 has an approximately rectangular parallelepiped shape, and includes a surface 1*e* in the Z axis positive direction, a surface 1*f* in the Z axis negative direction, a surface 1*g* in the X axis positive direction, a surface 1*h* in the X axis negative direction, a surface 1*i* in the Y axis positive direction, and a surface 1*j* in the Y axis negative direction. Hereinafter, for the sake of easier understanding, the surface 1*e* is referred to as an upper surface, the surface 1*f* is referred to as a bottom surface, the surface 1*g* is referred to as a right surface, the surface 1*h* is referred to as a left surface, the surface 1*i* is referred to as a front surface, and the surface 1*j* is referred to as a rear surface. Further, the surfaces 1*e* to 1*j* sides are referred to as an upper surface side, a bottom surface side, a right surface side, a left surface side, a front surface side, and a rear surface.

A liquid supplying portion 50 having a supply hole for supplying ink to the printer is provided on the bottom surface 1*f*. Additionally, an atmosphere releasing hole 100 for introducing atmosphere inside the ink cartridge 1 is provided in the bottom surface 1*f* (FIG. 6).

The atmosphere releasing hole 100 has a depth and a diameter that fit the protrusions 63 (FIG. 2) formed in the recording head unit 60 of the ink jet printer to have a certain interval. The user removes a sealing film 90 that tightly seals the atmosphere releasing hole 100 and then mounts the ink cartridges 1 onto the holder 62. The protrusions 63 serve a function of preventing the user from forgetting to remove the sealing film 90.

An engaging lever 11 is provided on the right side surface 1*h*. A protrusion 11*a* is formed in the engaging lever 11. When the ink cartridges 1 are mounted in the holder 62, the protrusion 11*a* is engaged with the cavities 64 of the holder 62 so that the ink cartridges 1 are fixed to the holder 62 (FIG. 2).

A circuit substrate 34 is provided on the lower portion of the engaging lever 1*l* of the right side surface 1*h* (FIG. 4). A plurality of electrode terminals 34*a* are formed on the circuit substrate 34, and the electrode terminals 34*a* are electrically connected to the carriage circuit through a connection mechanism (not illustrated) provided in the carriage 6.

An external surface film 55 is bonded to the front surface 1*e* and the rear surface 1*j* of the ink cartridge 1.

Additionally, the internal configuration of the ink cartridge 1 and the configurations of components are described with reference to FIGS. 5 to 6. The ink cartridge includes a cartridge body 10, and a lid member 20 that covers the front surface side of the cartridge body 10.

Ribs 10*a* having various forms are formed on the front surface side of the cartridge body 10 (FIG. 5). A film 80 that covers the front surface side of the cartridge body 10 is provided between the cartridge body 10 and the lid member 20. The film 80 is closely bonded so that there is no gap in the end surfaces of the ribs 10*a* on the front surface side of the cartridge body 10. A plurality of small spaces, for example, ink accommodation chambers and buffer chambers which are described below, are partitioned and formed inside the ink cartridge 1, with the ribs 10*a* and the film 80. The respective spaces are later described in greater detail.

A differential pressure valve accommodation chamber 40*a* and a gas-liquid separating chamber 70*a* are formed on the rear surface side of the cartridge body 10 (FIG. 6). The differential pressure valve accommodation chamber 40*a* accommodates a differential pressure valve 40 formed of a valve member 41, a spring 42, and a spring seat 43. An embankment 70*b* which is formed in the inner wall that encloses the bottom surface of the gas-liquid separating chamber 70*a* and a gas-liquid separating film 71 is bonded to the embankment 70*b* so that a gas-liquid separating filter 70 is configured to be whole.

Additionally, a plurality of grooves 10*b* are formed on the rear surface of the cartridge body 10 (FIG. 6). When the external surface film 55 is bonded so that nearly the entire rear surface of the cartridge body 10 is covered, the grooves 10*b* form various channels described below between the cartridge body 10 and the external surface film 55, for example, channels through which the ink and the atmosphere flow.

Next, the structure near the circuit substrate 34 described above is described. A sensor accommodation chamber 30*a* is formed on the lower surface side on the right surface of the cartridge body 10 (FIG. 6). A residual liquid amount sensor module 31 and a fixing spring 32 are accommodated in the sensor accommodation chamber 30*a*. The fixing spring 32 pushes and fixes the residual liquid amount sensor module 31 to the inner wall on the lower surface side of the sensor accommodation chamber 30*a*. The opening on the right surface side of the sensor accommodation chamber 30*a* is covered with a covering member 33, and the aforementioned circuit substrate 34 is fixed to an external surface 33*a* of the covering member 33. The sensor accommodation chamber 30*a*, the residual liquid amount sensor module 31, the fixing spring 32, the covering member 33, the circuit substrate 34, and the sensor channel forming chamber 30*b* described below are all referred to as a sensor portion 30.

A rewritable nonvolatile memory such as Electronically Erasable and Programmable Read Only Memory (EEPROM) is provided on the circuit substrate 34, and an ink consumption amount of the printer 1000 or the like are recorded.

Together with the liquid supplying portion 50 and the atmosphere releasing hole 100, a pressure reducing hole 110, a sensor channel forming chamber 30*b*, and a maze channel forming chamber 95*a* are provided on the bottom surface side of the cartridge body 10 (FIG. 4). When the ink cartridge 1 is filled with the ink in the manufacturing process of the ink cartridge 1, the pressure reducing hole 110 is used to reduce the pressure inside the ink cartridge 1 by extracting the gas within. The sensor channel forming chamber 30*b* and the maze channel forming chamber 95*a* form a part of the ink accommodation portion described below.

Immediately after the ink cartridge 1 is manufactured, opening portions of the liquid supplying portion 50, the atmosphere releasing hole 100, the pressure reducing hole 110, the maze channel forming chamber 95*a*, and the sensor channel forming chamber 30*b* are sealed with sealing films 54, 90, 98, 95, and 35, respectively. Among these, the sealing film 90 is removed by the user before the ink cartridge 1 is mounted onto the carriage 6 of the printer as described above. According to this, the atmosphere releasing hole 100 communicates with the external portions, and introduces atmosphere to the inside of the ink cartridge 1. Further, the sealing film 54 is configured to be pierced by an ink supply needle provided on the carriage 6 when the ink cartridge 1 is mounted onto the carriage 6 of the printer.

A seal member 51, a spring seat 52, and a blocking spring 53 are accommodated in the liquid supplying portion 50 in sequence from the lower surface side. The seal member performs sealing so that there is no gap between the inner wall of the liquid supplying portion 50 and the external wall of the ink supply needle 66, when an ink supply needle 66 is inserted into the liquid supplying portion 50. When the ink cartridge 1 is not mounted on the carriage 6, the spring seat 52 comes into contact with the inner wall of the seal member 51, and closes the liquid supplying portion 50. The blocking spring 53 energizes the spring seat 52 in a direction in which the spring seat 52 comes into contact with the inner wall of the seal member 51. If the ink supply needle is inserted into the liquid supplying portion 50, the upper end of the ink supply needle pushes up the spring seat 52, and a gap is generated between the spring seat 52 and the seal member 51, so that ink is supplied from the gap to the ink supply needle.

Figure 7:
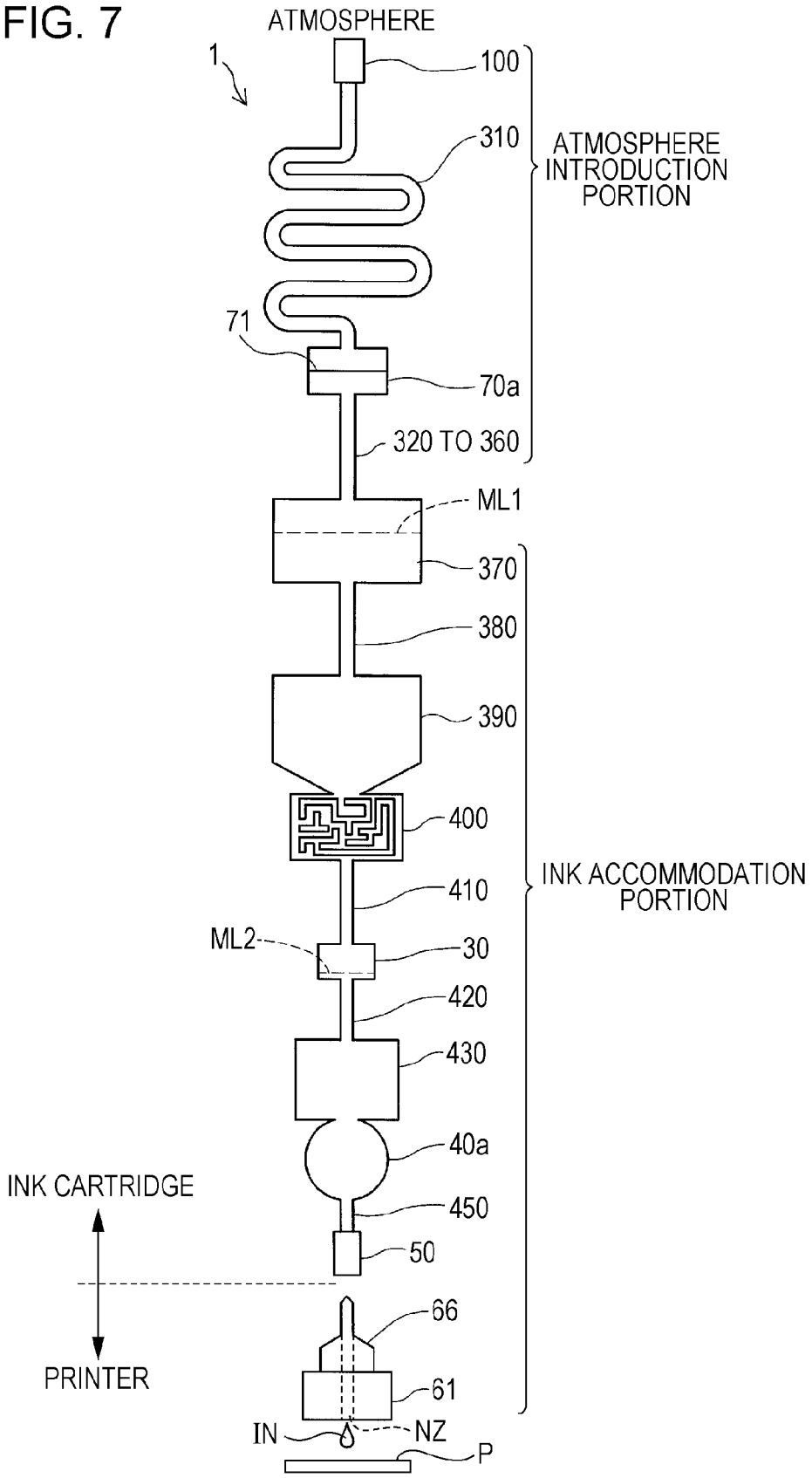
FIG. 7 is a diagram schematically illustrating a passage from an atmosphere releasing hole to a liquid supplying portion of the ink accommodation body according to the embodiment.

Next, for the sake of easier understanding, a passage from the atmosphere releasing hole 100 to the liquid supplying portion 50 is schematically described with reference to FIG. 7. FIG. 7 is a diagram schematically illustrating the passage from the atmosphere releasing hole to the liquid supplying portion.

The passage from the atmosphere releasing hole 100 to the liquid supplying portion 50 is roughly divided into an atmosphere introduction portion on the upper stream side and an ink accommodation portion on the lower stream side.

The atmosphere introduction portion is configured with a meandering passage 310, the gas-liquid separating chamber 70*a* that receives the aforementioned gas-liquid separating film 71, and coupling portions 320 to 360 that couple the gas-liquid separating chamber 70*a* and the ink accommodation portion in sequence from the upper stream side. The upper stream end of the meandering passage 310 communicates with the atmosphere releasing hole 100, and the lower stream end thereof communicates with the gas-liquid separating chamber 70*a*. The meandering passage 310 is formed to meander in a long and narrow manner so as to increase the distance from the atmosphere releasing hole 100 to the first ink accommodation portion. Accordingly, it is possible to suppress the evaporation of the moisture in the ink in the ink accommodation portion. The gas-liquid separating film 71 is configured with a material that allows the penetration of the gas and does not allow the penetration of the liquid. The ink that flows backward from the ink accommodation portion can be prevented from entering the upper stream of the gas-liquid separating chamber 70*a* by disposing the gas-liquid separating film 71 between the upper stream side and the lower stream side of the gas-liquid separating chamber 70*a*. The detailed configurations of the coupling portions 320 to 360 are described below.

A first ink accommodation chamber 370, a accommodation chamber connecting passage 380, and a second ink accommodation chamber 390 are provided on the upper stream side of ink accommodation portion in this sequence. The upper stream side of the accommodation chamber connecting passage 380 communicates with the first ink accommodation chamber 370, and the lower stream side of the accommodation chamber connecting passage 380 communicates with the second ink accommodation chamber 390.

Additionally, the ink accommodation portion includes a maze channel 400, a first flowing passage 410, the aforementioned sensor portion 30, a second flowing passage 420, a buffer chamber 430, the differential pressure valve accommodation chamber 40*a* that accommodates the aforementioned differential pressure valve 40, and a third flowing passage 450 on the lower stream side of the second ink accommodation chamber 390, in this sequence. The maze channel 400 includes a space formed by the aforementioned maze channel forming chamber 95*a*, and is formed in a three dimensional maze shape. It is possible to prevent the bubbles from being mixed into the ink on the lower stream rather than the maze channel 400 by supplying bubbles mixed into the ink by the maze channel 400. The upper stream end of the first flowing passage 410 communicates with the maze channel 400 and the lower stream end thereof communicates with the sensor channel forming chamber 30*b* of the sensor portion 30. The upper stream side of the second flowing passage 420 communicates with the sensor channel forming chamber 30*b* of the sensor portion 30, and the lower stream side of the second flowing passage 420 communicates with the buffer chamber 430. The buffer chamber 430 is a space for accumulating a certain amount of ink so that a certain amount of recording can be performed even if the ink is used up and the sensor portion 30 detects that the ink has run out. The buffer chamber 430 communicates with the differential pressure valve accommodation chamber 40*a*. The pressure of the ink on the lower stream side of the differential pressure valve accommodation chamber 40*a* is adjusted to be lower than the pressure of the ink on the upper stream side by the differential pressure valve 40 in the differential pressure valve accommodation chamber 40*a*, so that the ink on the lower stream side has negative pressure. The upper stream end of the third flowing passage 450 communicates with the differential pressure valve accommodation chamber 40*a*, and the lower stream end thereof communicates with the liquid supplying portion 50.

The liquid supplying portion 50 is inserted into the ink supply needle 66 disposed on the upper surface of the recording head 61. The ink accommodated in the liquid supplying portion 50 is supplied to the recording head 61 through the ink supply needle 66. The recording head 61 ejects the supplied ink onto the paper P from a nozzle NZ formed on the lower surface according to the control of the main control unit 2.

At the time of manufacturing the ink cartridges 1, the ink cartridges 1 are filled with the ink to reach the first ink accommodation chamber 370 positioned on the uppermost stream side of the ink accommodation portion, and the liquid surface is conceptually indicated by a broken line ML1 in FIG. 7. If the ink in the ink cartridge 1 is consumed by the recording head 61, the liquid flows to the lower stream. Accordingly, the liquid surface moves to the lower stream side, and, instead of the liquid, the atmosphere flows into the ink accommodation portion from the upper stream through the atmosphere introduction portion. Then, when the ink is constantly consumed, the liquid surface which is conceptually indicated by a broken line ML2 in FIG. 7 reaches the sensor portion 30. Then, the atmosphere is introduced to the sensor portion 30, and the depletion of the ink is detected by the residual liquid amount sensor module 31. If the depletion of the ink is detected, the ink cartridge 1 stops recording at a stage before the ink existing on the lower stream side (the buffer chamber 430 or the like) of the sensor portion 30 is completely consumed, and notifies the user of the depletion of the ink. If the recording is performed when the ink is completely consumed, the air is mixed into the recording head 61, and there is a concern that a malfunction will occur.

Figure 8:
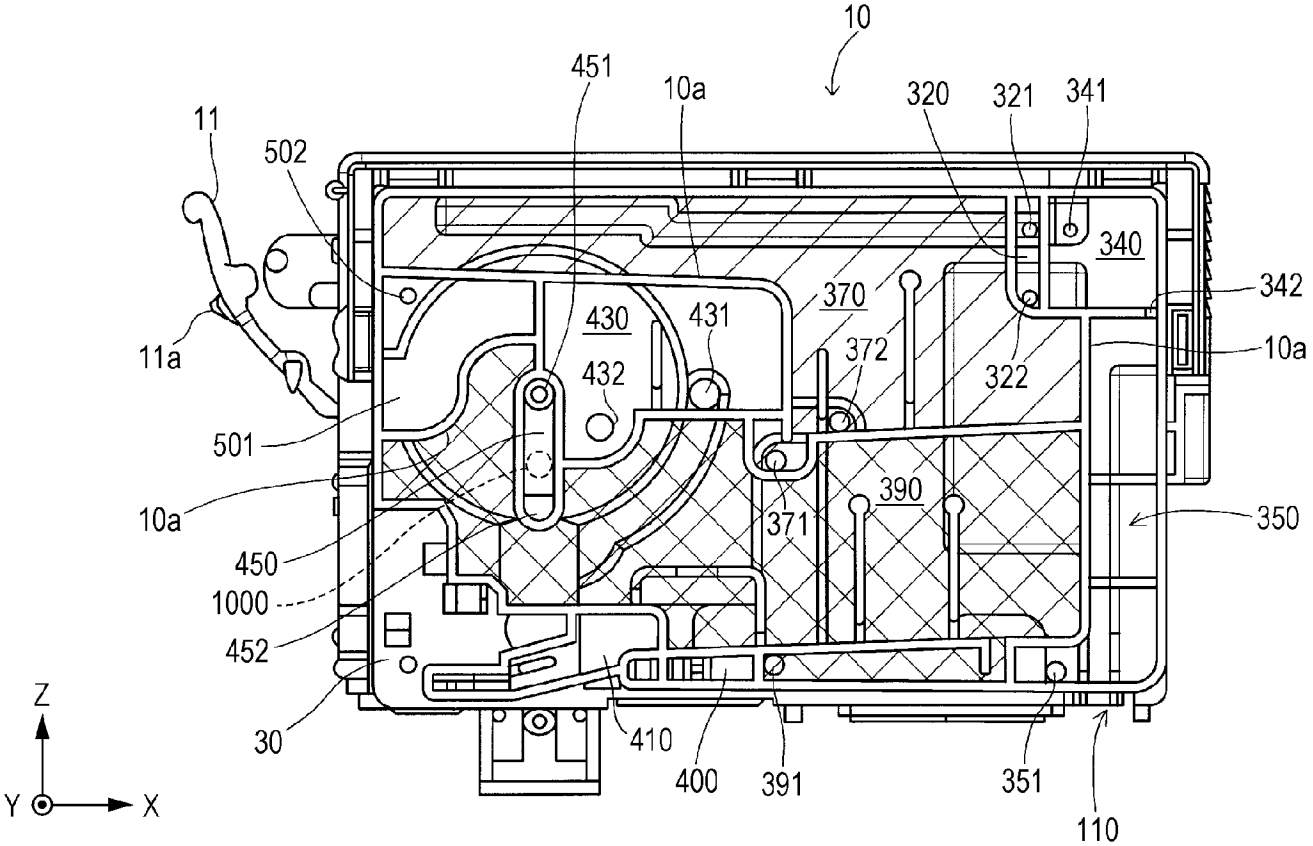
FIG. 8 is a diagram schematically illustrating a state in which the ink accommodation body according to the embodiment is seen from the front surface side.
Figure 9:
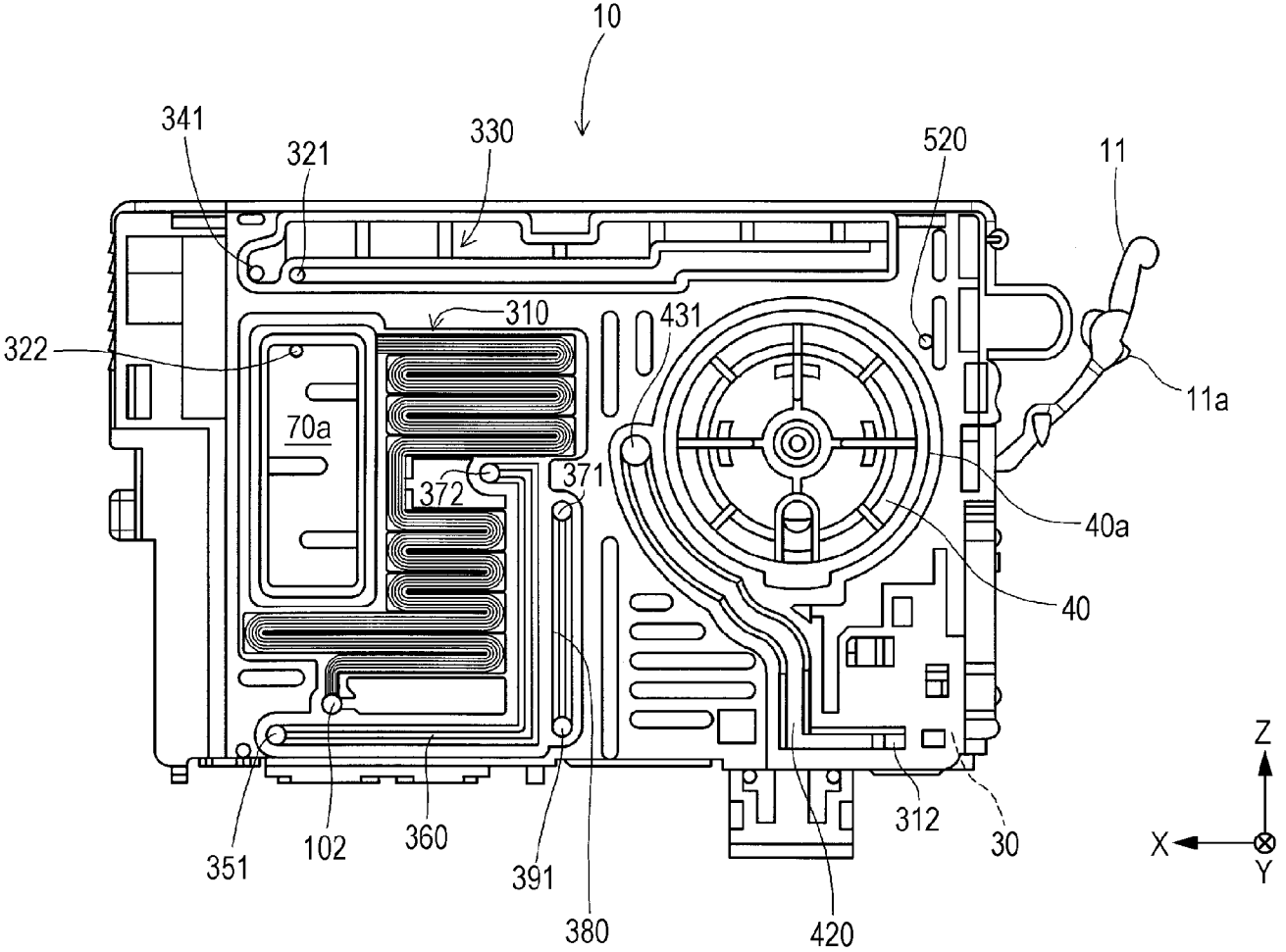
FIG. 9 is a diagram schematically illustrating a state in which the ink accommodation body according to the embodiment is seen from the rear surface side.
Figure 10A:
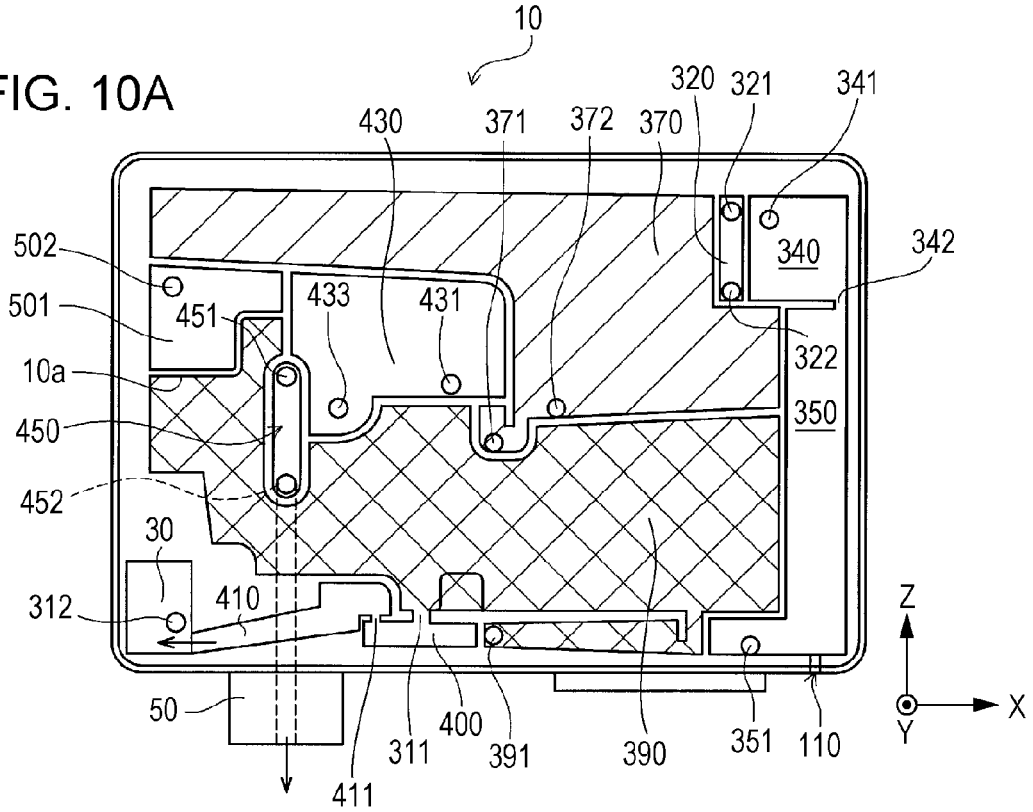
FIGS. 10A and 10B are diagrams schematically illustrating the ink accommodation bodies illustrated in FIGS. 8 and 9 in a simplified manner.
Figure 10B:
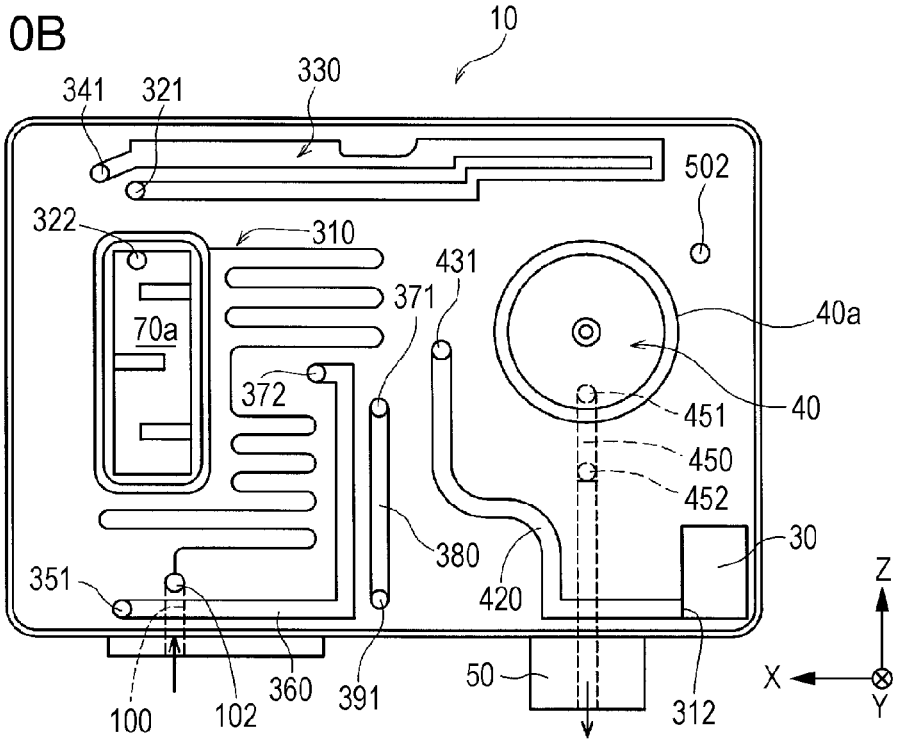

In addition to the description above, the specific configurations in the ink cartridge 1 of respective components of the passage from the atmosphere releasing hole 100 to the liquid supplying portion 50 are described with reference to FIGS. 8 to 10B. FIG. 8 is a diagram illustrating the cartridge body 10 seen from the front surface side. FIG. 9 is a diagram illustrating the cartridge body 10 seen from the rear surface side. FIG. 10A is a diagram schematically illustrating the cartridge body 10 of FIG. 8 in a simplified manner. FIG. 10B is a diagram schematically illustrating the cartridge body 10 of FIG. 9 in a simplified manner.

Among the ink accommodation portions, the first ink accommodation chamber 370 and the second ink accommodation chamber 390 are formed on the front surface side of the cartridge body 10. In FIGS. 8 and 10A, the first ink accommodation chamber 370 and the second ink accommodation chamber 390 are illustrated by single hatching and cross hatching patterns, respectively. The accommodation chamber connecting passage 380 is formed on the rear surface side of the cartridge body 10, at a position illustrated in FIGS. 9 and 10B. A communication hole 371 is a hole that causes the upper stream end of the accommodation chamber connecting passage 380 and the first ink accommodation chamber 370 to communicate with each other, and a communication hole 391 is a hole that causes the lower stream end of the accommodation chamber connecting passage 380 and the second ink accommodation chamber 390 to communicate with each other.

Among the atmosphere introduction portions, the meandering passage 310 and the gas-liquid separating chamber 70*a* are formed on the rear surface side of the cartridge body 10 at positions illustrated in FIGS. 9 and 10B. A communication hole 102 is a hole that causes the upper stream end of the meandering passage 310 and the atmosphere releasing hole 100 to communicate with each other. The lower stream end of the meandering passage 310 penetrates the side wall of the gas-liquid separating chamber 70*a*, and communicates with the gas-liquid separating chamber 70*a*.

When described in detail, the coupling portions 320 to 360 of the atmosphere introduction portion illustrated in FIG. 7 include a first space 320, a third space 340, and a fourth space 350 disposed on the front surface side of the cartridge body 10 (see FIGS. 8 and 10A), and a second space 330 and a fifth space 360 disposed on the rear surface side of the cartridge body 10 (see FIGS. 9 and 10B), and the respective spaces form one channel from the upper stream in series in a sequence of reference numerals. A communication hole 322 causes the gas-liquid separating chamber 70*a* and the first space 320 to communicate with each other. Communication holes 321 and 341 cause the first space 320 and the second space 330 to communicate with each other, and cause the second space 330 and the third space 340 to communicate with each other. The third space 340 and the fourth space 350 communicate with each other through a notch 342 formed in the rib that partitions the third space 340 and the fourth space 350. Communication holes 351 and 372 cause the fourth space 350 and the fifth space 360 to communicate with each other and the fifth space 360 and the first ink accommodation chamber 370 to communicate with each other, respectively.

Out of the ink accommodation portions, the maze channel 400 and the first flowing passage 410 are formed on the front surface side of the cartridge body 10 at positions illustrated in FIGS. 8 and 10A. A communication hole 311 is provided in the rib that partitions the second ink accommodation chamber 390 and the maze channel 400, and causes the second ink accommodation chamber 390 and the maze channel 400 to communicate with each other. The sensor portion 30 is disposed on the right surface of the cartridge body 10 on the lower surface side as described with reference to FIG. 6 (FIGS. 8 to 10B). The second flowing passage 420 and the aforementioned gas-liquid separating chamber 70*a* are formed on the rear surface side of the cartridge body 10 at positions illustrated in FIGS. 9 and 10B, respectively. The buffer chamber 430 and the third flowing passage 450 are formed at positions illustrated in FIGS. 8 and 10A on the front surface side of the cartridge body 10. A communication hole 312 is a hole that causes the maze channel forming chamber 95*a* of the sensor portion 30 (FIG. 6) and the upper stream end of the second flowing passage 420 to communicate with each other, and a communication hole 431 is a hole that causes the lower stream end of the second flowing passage 420 and the buffer chamber 430 to communicate with each other. A communication hole 432 is a hole that causes the buffer chamber 430 and the differential pressure valve accommodation chamber 40*a* to directly communicate with each other. A communication hole 451 and a communication hole 452 are holes that cause the differential pressure valve accommodation chamber 40*a* and the third flowing passage 450 to communicate with each other and the third flowing passage 450 and the ink supplying hole in the liquid supplying portion 50 to communicate with each other, respectively.

In addition, a space 501 illustrated in FIGS. 8 and 10A is an unfilled chamber in which ink is not filled. The unfilled chamber 501 is not in the passage from the atmosphere releasing hole 100 to the liquid supplying portion 50, but is independently formed. An atmosphere communication hole 502 that communicates with the atmosphere is provided on the rear surface side of the unfilled chamber 501. The unfilled chamber 501 is a deaeration chamber in which negative pressure is accumulated when the ink cartridge 1 is packaged by a pressure-reduced package such as a package body 800 to be described below. Accordingly, when the ink cartridge 1 is packaged, the atmospheric pressure in the cartridge body 10 is maintained to be equal to or lower than a specified value so that the ink having less dissolved air can be supplied.

1.3. Characteristics of Respective Members

Hereinafter, characteristics of the packing body for packing the ink accommodation body, the sealing member for sealing the atmosphere opening hole, and the members for configuring the ink accommodation body are described.

Package Body

Figure 11:
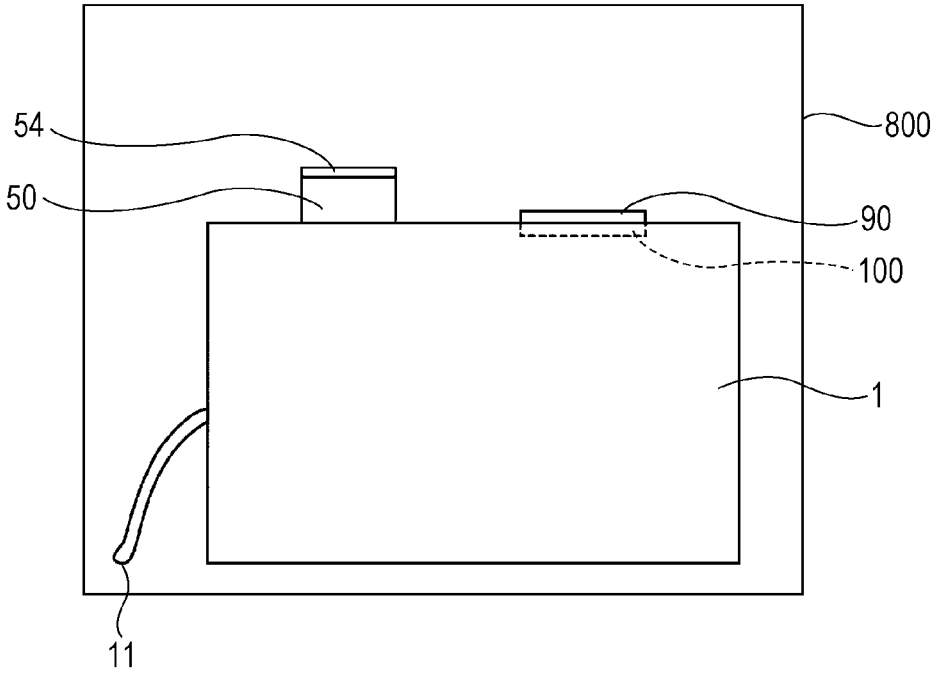
FIG. 11 is a diagram schematically illustrating a state in which the ink accommodation body according to the embodiment is packaged by a package body.

The ink accommodation body according to the embodiment is packaged by the package body, and the entire ink accommodation body is enclosed inside the package body. FIG. 11 is a diagram schematically illustrating a state in which the aforementioned ink cartridge 1 is packaged by the package body 800. The package body 800 is used for covering the entire surface of the ink cartridge 1, maintaining the deaeration state of the ink accommodated in the ink cartridge, and protecting the ink cartridge 1 from scratches, impacts, or the like when the ink cartridge 1 is transported or stored.

In order to apply negative pressure inside the ink cartridge, when deaeration is performed in the ink cartridge and the package body 800 after the ink cartridge 1 is packaged by the package body, the package body 800 is preferably formed of a flexible member (for example, films).

The package body 800 is preferably formed of a single material, and may be formed of a combination of a plurality of materials. Specifically, when the package body 800 is formed of a film, the package body 800 includes a configuration of a single layer or a configuration of two or more layers. When the package body 800 is configured of two or more films, respective layers may be bonded by a bonding agent, or may be bonded by heat or the like.

The hydrogen gas transmission rate of the package body 800 is required to be equal to or greater than 0.0001 $ml/cm^2 \cdot day \cdot atm$ and equal to or less than 0.01 $ml/cm^2 \cdot day \cdot atm$, preferably equal to or greater than 0.001 $ml/cm^2 \cdot day \cdot atm$ and equal to or less than 0.01 $ml/cm^2 \cdot day \cdot atm$, and more preferably equal to or greater than 0.002 $ml/cm^2 \cdot day \cdot atm$ and equal to or less than 0.009 $ml/cm^2 \cdot day \cdot atm$. Accordingly, since the gas (particularly, hydrogen) discharged from the inside of the ink cartridge and existing between the package body 800 and the ink cartridge 1 can be easily discharged to the outside of the package body 800, the deformation or the damage to the package body 800 or the like can be prevented. Meanwhile, if the hydrogen gas transmission rate of the package body 800 exceeds 0.01 $ml/cm^2 \cdot day \cdot atm$, the deaeration state of the package body may not be sufficiently maintained. Further, if the hydrogen gas transmission rate of the package body 800 is less than 0.0001 $ml/cm^2 \cdot day \cdot atm$, hydrogen may be generated by an unintended reaction of a water resistant aluminum pigment and an aqueous medium, and the pressure thereof in the package body 800 accumulated in the package body 800 increases to exceed the pressure tolerance of the package body 800, the package body 800 may be broken.

Examples of a material that satisfies the hydrogen gas transmission rate and configures the package body 800 include alumina, polyester, polyethylene, and ethylene-vinyl acetate copolymer.

The hydrogen gas transmission rate of the package body 800 can be measured based on Archimedes' principle, and the specific calculation is as follows. First, the package (having the same thickness as the package body 800) that uses the package body 800 and can be tightly closed is prepared, and the inside of the package is filled with hydrogen gas, and the package is tightly closed. After the package is tightly closed, the package in water of a measuring cylinder is completely immersed to record the volume increase [H1 (ml)] of the water. Then, the package is extracted from the measuring cylinder and maintained for 24 hours under conditions of a 25° C. temperature and 50% RH humidity, and the package is completely immersed in the water of the measuring cylinder to record the volume increase [H2 (ml)] of the water, again. Then, the difference between the H1 and H2 (H1− H2) is divided by the surface area ($cm^2$) of the surface in the package to derive the hydrogen gas transmission rate [H3 ($ml/cm^2 \cdot day \cdot atm$)] under the condition of 25° C. for one day.

The preferable water vapor transmission rate of the package body 800 under the condition of 25° C. for one day is equal to or greater than 0.1 $\mu g/cm^2 \cdot day \cdot atm$ and equal to or less than 6.0 $\mu g/cm^2 \cdot day \cdot atm$ for one day, and more preferably equal to or greater than 0.5 $\mu g/cm^2 \cdot day \cdot atm$ and equal to or less than 4 $\mu g/cm^2 \cdot day \cdot atm$. Accordingly, it is possible to prevent moisture from being discharged to the outside of the package body 800, and it is possible to enhance the storage stability of the ink accommodated in the ink cartridge 1.

The water vapor transmission rate of the package body 800 is measured as follows. First, a package (having the same thickness as the package body 800) that uses the package body 800 and is immersed in water is prepared, the package is tightly closed after the inside of the package is filled with water, and a mass [W1 (g)] of the package immediately after being tightly closed is recorded. Then, the package is stored for 24 hours under the condition of 25° C., and then a mass [W2 (g)] of the package is recorded again. In this manner, the difference [W1−W2 (g)] between W1 and W2 is divided by the surface area ($cm^2$) of the surface in the package to derive a water vapor transmission rate [W3 ($g/cm^2 \cdot day \cdot atm$)] under the condition of 25° C. for one day.

The thickness of the package body 800 can be appropriately set to satisfy the hydrogen gas transmission rate, and can be set to be, for example, equal to or greater than 50 μm and to equal to or less than 700 μm.

The method of packaging the ink cartridge 1 with the package body 800 is not particularly limited, but the method can include a method of inserting the ink accommodation body 1 from an open part of the bag-shaped package body 800 sealed in three directions and then sealing the open part or a method of wrapping the ink accommodation body 1 by folding the package body 800 formed of the sheet-shaped film. When the ink cartridge 1 is packed with the package body 800, a deaeration process of discharging the gas existing in the ink cartridge 1 or in the package body to the outside can be performed by any well-known method.

The package body 800 preferably includes a first region and a second region having pressure tolerance lower than that of the first region. Accordingly, the internal pressure of the package body 800 is increased by the gas discharged from the ink cartridge 1, and even if the package body 800 is broken, the second region is broken prior to the first region. Therefore, the rapid fragmentation of the package body 800 can be prevented.

A method of setting pressure tolerance of the second region to be lower than that of the first region is not particularly limited, and can be performed by causing the thickness of the second region to be thinner than that of the first region, using a member having lower pressure tolerance than that in the first region, as a member configuring the second region, creating a cut in the second region, lowering a bonding condition (for example, temperature) of film members, and the like.

The ratio (X/Y) between a surface area (X) inside the package body 800 and a surface area (Y) of the ink cartridge 1 is preferably equal to or greater than 1.05 and equal to or less than 2.0, and equal to or greater than 1.2 and equal to or less than 1.6. Accordingly, since it is possible to minimize the inflow and the outflow of water (vapor) while preventing hydrogen generated by an unintended reaction of a water resistant aluminum pigment and an aqueous medium from being accumulated in the package body 800, it is possible to favorably maintain the quality of the ink.

Sealing Member

The atmosphere opening hole is preferably sealed by the sealing member that tightly seals the atmosphere opening hole, immediately after manufacturing the ink accommodation body according to the embodiment. Specifically, as illustrated in FIGS. 4 and 6, an atmosphere opening hole 100 is sealed with the sealing film 90.

The sealing film 90 may be formed of a single material, or may be formed of a combination of a plurality of materials. Specifically, the sealing film 90 may be formed of a film of a single layer, a film of two or more layers, or the like. When the sealing film 90 is formed of the film of two or more layers, the film can be obtained by bonding respective layers by a bonding agent, or may be obtained by bonding respective layers by heat or the like.

Here, the inside of the ink cartridge 1 (that is, ink accommodation portion) is filled with the ink containing the base metal pigment. Therefore, after the ink cartridge 1 is packaged with the package body 800, gas (particularly, hydrogen) caused by the ink in the ink accommodation portion may be generated. The generated gas may be passed through the atmosphere introduction portion and discharged from the atmosphere opening hole 100 (see FIG. 7). Therefore, the gas reaching the atmosphere opening hole 100 is blocked from being discharged into the package body 800 by the sealing film 90, but is transmitted into the package body 800 by the gas permeability of the sealing film 90. Especially, from the viewpoint of preventing the ink cartridge 1 from being excessively deformed or broken by the generated gas, the sealing film 90 preferably allows gas permeability (particularly, hydrogen) to a certain degree.

From this viewpoint, the hydrogen gas transmission rate in the sealing film 90 is preferably equal to or greater than 0.0001 $ml/cm^2 \cdot day \cdot atm$ and equal to or less than 0.01 $ml/cm^2 \cdot day \cdot atm$, more preferably equal to or greater than 0.001 $ml/cm^2 \cdot day \cdot atm$ and equal to or less than 0.01 $ml/cm^2 \cdot day \cdot atm$, and still more preferably 0.002 $ml/cm^2 \cdot day \cdot atm$ and equal to or less than 0.009 $ml/cm^2 \cdot day \cdot atm$. Accordingly, gas (particularly, hydrogen) generated in the ink cartridge is easily discharged to the outside (that is, the inside of the package body 800) of the ink cartridge 1, it is possible to prevent the ink cartridge 1 from being excessively deformed or broken. In addition, the hydrogen gas transmission rate of the sealing film 90 can be measured by the same method of measuring the hydrogen gas transmission rate of the package body 800 described above.

Examples of a material of configuring the sealing film 90 satisfying the hydrogen gas transmission rate include alumina, polyester, polyethylene, and ethylene-vinyl acetate copolymer. Further, the thickness of the sealing film 90 can be appropriately set so as to satisfy the hydrogen gas transmission rate, and, for example, be equal to or greater than 50 μm and equal to or less than 700 μm.

When the gas generated in the ink cartridge 1 is discharged into the package body 800 through the sealing film 90, if the amount of the gas (particularly, hydrogen) discharged from the sealing film 90 per each unit of time is great, too much gas is accumulated in the package body 800, and the package body 800 may be excessively deformed or broken. In order to solve the problem as described above, when the product of the hydrogen gas transmission rate of the sealing film 90 and the size of the portion of the sealing film 90 that covers the atmosphere opening hole 100 is set to be A, the product of the hydrogen gas transmission rate of the package body 800 and the surface area (that is, the surface area inside the package body 800) of the package body 800 is set to be B, and the relationship of A<B is preferably satisfied. Accordingly, the gas discharged from the sealing film 90 is easily discharged to the package body 800, so it is possible to prevent the package body 800 from being excessively deformed or broken.

The water vapor transmission rate of the sealing film 90 is preferably equal to or greater than 0.1 $\mu g/cm^2 \cdot day \cdot atm$ and equal to or less than 6.0 $\mu g/cm^2 \cdot day \cdot atm$ under the circumstance of 25° C. for one day, and is more preferably equal to or greater than 0.5 $\mu g/cm^2 \cdot day \cdot atm$ and equal to or less than 4 $\mu g/cm^2 \cdot day \cdot atm$. Accordingly, it is possible to prevent moisture from being discharged to the outside of the sealing film 90 and to enhance the storage stability of the ink accommodated in the ink cartridge 1. In addition, the water vapor transmission rate of the sealing film 90 can be measured by the same method of measuring the vapor (water) transmission amount of the package body 800 described above.

The sealing film 90 preferably includes a first region and a second region having lower pressure tolerance than the first region. Accordingly, the internal pressure of the sealing film 90 is increased by the gas generated from the ink accommodated in the ink accommodation portion, and even if the sealing film 90 is broken, the second region is broken prior to the first region. Therefore, the rapid fragmentation of the sealing film 90 can be prevented.

A method of setting the pressure tolerance of the second region to be lower than that of the first region is not particularly limited, and can be performed by causing the thickness of the second region to be thinner than that of the first region, using a member having lower pressure tolerance than that in the first region, as a member configuring the second region, creating a cut in the second region, lowering a bonding condition (for example, temperature) of the sealing film 90, and the like.

Member Configuring Ink Accommodation Body

Since the ink containing the base metal pigment is accommodated in the ink accommodation portion illustrated in FIG. 7, the gas (particularly, hydrogen gas) caused by the ink may exist. Further, the gas generated in the ink accommodation portion exists in the atmosphere introduction portion illustrated FIG. 7. Therefore, the gas included in the ink accommodation portion and the atmosphere introduction portion is discharged from the inside of the ink accommodation portion and the inside of the atmosphere introduction portion to the outside of the ink accommodation body by passing through the surface of the ink accommodation body.

In order to preventing the gas generated inside the ink cartridge 1 from being discharged from portions other than the atmosphere opening hole 100 in this manner, the hydrogen gas transmission rate existing between the inside of the ink accommodation portion or the inside of the atmosphere opening portion, and the surface of the ink cartridge 1 is preferably lower than the hydrogen gas transmission rate of the sealing film 90.

In addition, the hydrogen gas transmission rate of the member existing between the inside of the ink accommodation portion or the inside of the atmosphere opening portion and the surface of the ink cartridge 1 can be measured by the same method of measuring the hydrogen gas transmission rate of the package body 800 described above except that the ink accommodation portion and the atmosphere opening portion of the ink cartridge 1 are filled with hydrogen gas, and then the atmosphere opening hole is tightly closed with a material that does not transmit hydrogen.

The ink containing the base metal pigment is accommodated in the ink accommodation portion illustrated in FIG. 7. Further, in addition to the gas generated in the ink accommodation portion, the ink flowing out from the ink accommodation portion may exist in the atmosphere introduction portion illustrated in FIG. 7. Therefore, the moisture (vapor) included in the ink existing in the ink accommodation portion and in the atmosphere introduction portion passes through the surface of the ink accommodation body from the inside of the ink accommodation portion and the inside of the atmosphere introduction portion, and is discharged to the outside of the ink accommodation body.

In order to prevent the moisture included in the ink in the ink cartridge 1 from being discharged in this manner, the water vapor transmission rate of the member existing between the inside of the ink accommodation portion or the inside of the atmosphere opening portion, and the surface of the ink cartridge 1 is preferably lower than the water vapor transmission rate of the sealing film 90. In addition, since the hole diameter of the atmosphere opening hole 100 is minute (to an extent of equal to or greater than 100 μm and equal to or less than 2 mm) to the extent that the ink flowing to the inside does not flow to the outside, even if the vapor is discharged from the atmosphere opening hole 100, the amount is extremely small.

In addition, the water vapor transmission rate of the member existing between the inside of the ink accommodation portion or the inside of the atmosphere opening portion, and the surface of the ink cartridge 1 can be measured using the same method of measuring the water vapor transmission rate of the package body 800 described above except that the ink accommodation portion and the atmosphere opening portion of the ink cartridge 1 are filled with water, and then the atmosphere opening hole is tightly closed with a material that does not transmit water.

1.4. Ink

The ink accommodated in the ink cartridge 1 according to the embodiment contains the base metal pigment.

Here, base metal indicates metal having greater ionization tendency than hydrogen. Examples of the base metal representatively include alkali metal, alkali earth metal, aluminum, and zinc. The base metal pigment may be an alloy including at least one kind of base metal. These materials tend to react with water or organic solvents included in the ink, and generate a lot of gas.

Hereinafter, the ink containing the aluminum pigment using aluminum which is the base metal as a material and water is described using the ink as an aspect of the ink according to the embodiment.

Aluminum Pigment

For example, the aluminum pigment may have a flat panel shape. Examples of the flat shape include a squamous shape, a leaf shape, a flat shape, and a film shape. The aluminum pigment may be covered with inorganic oxide or the like. The generation of bubbles in the ink may be prevented by the cover. If the aluminum pigment has a flat shape, a satisfactory metallic luster is easily obtained when the ink is attached to the recording medium.

A 50% average particle diameter R50 (hereinafter, simply referred to as "R50") of an equivalent circle diameter of the aluminum pigment covered with a covering film is preferably equal to or greater than 0.25 μm and equal to or less than 3 μm, more preferably equal to or greater than 0.5 μm and equal to or less than 2 μm, and still more preferably equal to or greater than 0.7 μm and equal to or less than 1.8 μm. The equivalent circle diameter is calculated from the sizes of particles in a projection image obtained by a particle image analyzer.

Examples of the particle image analyzer that measures the sizes of aluminum pigment particles in a projection image and equivalent circle diameters include flow-type particle image analyzers FPIA-2100, FPIA-3000, and FPIA-3000S (all manufactured by Sysmex Corporation). In addition, the average particle diameter of the equivalent circle diameter is a particle diameter based on the number of particles. Further, examples of the measuring method using FPIA-3000 or FPIA-3000S include measuring diameters in a HPF measurement mode by using a high-powered image capturing unit.

The maximum value of the equivalent circle diameters of aluminum pigment particles according to the embodiment is preferably equal to or less than 3 μm. If the maximum equivalent circle diameter of the particles is equal to or less than 3 μm, it is possible to prevent the nozzle opening portion or the ink channel from clogging when the particles are used in the ink jet recording apparatus.

Further, the thickness of the aluminum pigment particles is preferably equal to or greater than 5 nm and equal to or less than 100 nm, more preferably equal to or greater than 5 nm and equal to or less than 70 nm, and still more preferably equal to or greater than 10 nm and equal to or less than 50 nm.

In addition, the thickness is measured by using a transmission electron microscope, or a scanning electron microscope, and examples of the microscope include a transmission electron microscope (TEM: JEOL, JEM-2000EX), and a field emission scanning electron microscope (FE-SEM: Hitachi, S-4700). In addition, the thickness means average thickness, and is an average value obtained by performing the measurement ten times.

Examples of a material of the covering film when the aluminum pigment has a covering film include alkoxysilane (for example, tetraethoxysilane (TEOS)), polysilazane, and compounds derived from the compounds such as a fluorine-based material, a phosphorus-based material, and a phosphoric material.

Further, the aluminum pigment may be supplied in a dispersion liquid. Examples of components included in a dispersion liquid of the aluminum pigment include water, an organic solvent, a basic catalyst, a surfactant, tertiary amine, and a buffer solution, and the dispersion liquid can be obtained by appropriately combining the components.

Water

Pure water such as deionized water, ultrafiltered water, reverse osmotic water, and distilled water, and ultrapure water are preferably used as water. Especially, water subjected to the sterilization process by irradiating the water with ultraviolet light or adding hydrogen peroxide to the water is preferable since it is possible to prevent mold or bacteria from growing for a long period of time.

Others

Ink according to the embodiment may include other components. Examples of the components include an organic solvent, a catalyst, a surfactant, buffer, alkanediol, a pyrrolidone derivative, a pH regulator, a fixing agent such as water-soluble rosin, an anti-mold agent or preservative such as sodium benzoate, an oxidation inhibitor and an ultraviolet absorbing agent such as an agent of an allophanate class, a chelating agent, and an additive such as an oxygen absorber.

Ink

Concentration of an aluminum pigment in ink is preferably 0.1 to 5.0 mass %, more preferably 0.1 to 3.0 mass %, still more preferably 0.25 to 2.5 mass %, and particularly more preferably 0.5 to 2.0 mass %, as the solid concentration, with respect to the whole mass. The viscosity of the ink at 20° C. is preferably equal to or greater than 2 mPa·s and equal to or less than 10 mPa·s, and more preferably equal to or greater than 3 mPa·s and equal to or less than 5 mPa·s.

The ink composition is obtained by mixing respective components in an arbitrary order, and removing impurities by performing filtration or the like, if necessary. A method of mixing and stirring materials by sequentially adding the materials into a container including a stirring apparatus such as a mechanical stirrer and a magnetic stirrer is suitably used as a method of mixing respective components. As a filtration method, centrifugal filtration, filter filtration, or the like can be performed, if necessary.

The ink exemplified above can be set to be the ink accommodated in the ink cartridge 1 according to the embodiment. Since the ink contains the aluminum pigment and water, gas is easily generated with time.

2. Ink Accommodation Body Set

The ink accommodation body set according to the invention includes the aforementioned ink accommodation body (that is, the ink cartridges 1 packed by the package body 800) that accommodates the ink containing the base metal pigment and the color ink accommodation body that is packaged in the package body. The color ink accommodation body has the ink accommodation portion that accommodates the color ink containing coloring materials other than the base metal pigment and an atmosphere opening portion that is connected to the ink accommodation portion at one end, and communicates with the atmosphere. Hereinafter, the aforementioned ink accommodation body (the ink cartridge 1) that accommodates the ink containing the base metal pigment is referred to as a "base metal pigment ink accommodation body". Further, the color ink accommodation body is referred to as "color ink cartridge".

Color Ink Accommodation Body

Since the structure of the color ink accommodation body (color ink cartridge) is the same as that of the aforementioned ink cartridge 1, the detailed description thereof is omitted.

The package body that packages the color ink cartridge can package the color ink cartridge in the same method of the aforementioned package body 800 that packages the base metal pigment ink accommodation body.

The package body that packages the color ink cartridge may have the same characteristic as the hydrogen gas transmission rate of the aforementioned package body 800 that packages the base metal pigment ink accommodation body, but the characteristic is not limited thereto. For example, the hydrogen gas transmission rate of the package body that packages the color ink cartridge may be lower than the hydrogen gas transmission rate of the package body 800 that packages the base metal pigment ink accommodation body. This is because the package body that packages the color ink cartridge is seldom broken by gas alone, since the coloring materials other than the base metal pigment accommodated in the color ink cartridge generate less gas than the base metal pigment. In addition, the hydrogen gas transmission rate of the package body that packages the color ink cartridge can be measured by the same method of measuring the hydrogen gas transmission rate of the aforementioned package body 800.

Examples of the coloring material other than the base metal pigment accommodated in the color ink cartridge include a dye and a pigment. As the dye and the pigment, materials disclosed in U.S. Patent Application Publication Nos. 2010/0086690 and 2005/0235870, International Publication No. WO 2011/027842 can be suitably used. Between the dye and the pigment, the material including the pigment is more preferable. The pigment is preferably an organic pigment from the viewpoint of the storage stability such as light resistance, weather resistance, and gas resistance.

Specifically, as the pigment, an azo pigment such as an insoluble azo pigment, a condensed azo pigment, an azo lake pigment, and a chelate azo pigment, a polycyclic pigment such as a phthalocyanine pigment, a perylene and perynone pigment, an anthraquinone pigment, a quinacridone pigment, a dioxane pigment, a thioindigo pigment, an isoindolinone pigment, and a qhinophthalone pigment, a chelate dye, a lake pigment, a nitro pigment, a nitroso pigment, aniline black, a daylight fluorescent pigment, carbon black, and the like are used. The pigment can use a single material or a combination of two or more materials. Further, as the dye, various dyes that are used in general ink jet recording such as a direct dye, an acid dye, an edible dye, a basic dye, a reactive dye, a disperse dye, a vat dye, a soluble vat dye, and a reactive disperse dye can be used.

Examples of components that can be contained in the color ink other than the coloring material include water, an organic solvent, a catalyst, a surfactant, buffer, alkanediol, a pyrrolidone derivative, a pH regulator, a fixing agent such as water-soluble rosin, anti-mold agent or preservative such as sodium benzoate, an oxidation inhibitor and an ultraviolet absorbing agent such as an agent of an allophanate class, a chelating agent, and an additive such as an oxygen absorber.

Figure 12:
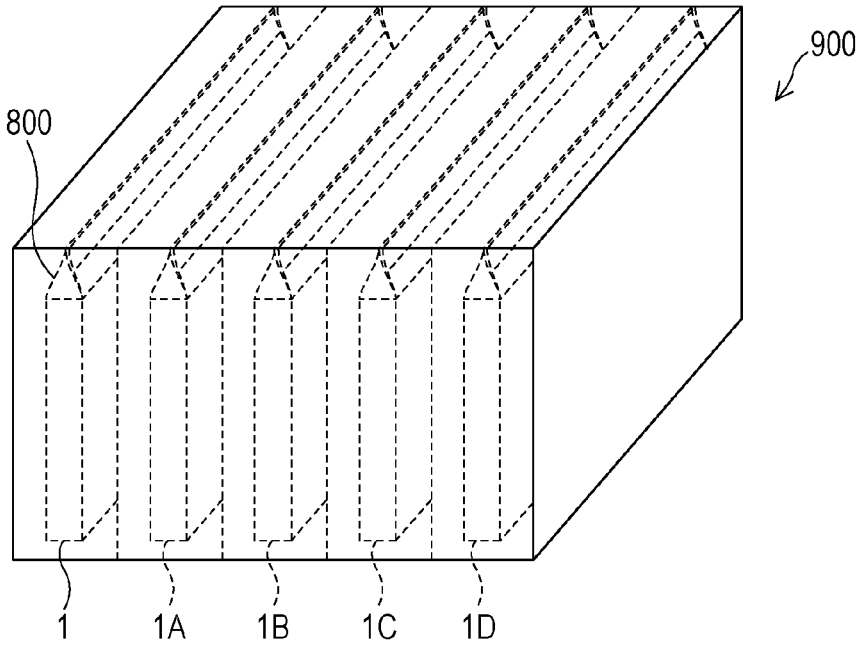
FIG. 12 is a diagram schematically illustrating a state in which a base metal pigment ink accommodation body and color ink accommodation bodies in the ink accommodation body set according to the embodiment are bundled in a housing.

Package Formation of Base Metal Pigment Ink Accommodation Body and Color Ink Accommodation Body The base metal pigment ink accommodation body packaged in the package body and the color ink accommodation bodies packaged in the package body may be bundled. FIG. 12 is a diagram schematically illustrating a state in which the base metal pigment ink accommodation body (the ink cartridge 1), the color ink storage bodies (color ink cartridges) 1A, 1B, 1C, and 1D are bundled in a housing 900 (for example, a box formed of paper). In this case, as illustrated in FIG. 12, the ink cartridge 1 is preferably disposed on the end side of the housing 900. Accordingly, even if the package body 800 is expanded by gas discharged from the ink cartridge 1, defects of pressing on the bundled color ink cartridges decrease.

The package body 800 that packages the ink cartridge 1 (base metal pigment ink accommodation body) may expand as described above. In such a case, when the space for accommodating the ink cartridge 1 is set to be larger than the capacity of the space for accommodating the color ink cartridge, even if the package body 800 expands, defects of pressing the bundled color ink cartridges decrease.

When the ink cartridge 1 (base metal pigment ink accommodation body) is packaged in the package body 800, the capacity of the package body 800 existing in the upper portion of the ink cartridge 1 (a position which becomes the upside when the ink accommodation body 1 is transported) is preferably greater than the capacity of the package body 800 existing on a side of the ink cartridge 1 and the capacity of the package body 800 existing on a lower side of the ink cartridge 1 (see FIG. 11). Since the gas (particularly, hydrogen gas) discharged from the ink cartridge 1 is collected on the upper side of the ink cartridge 1, there is an advantage in that the color ink cartridges existing on a side are pressed less when the ink cartridge 1 and the color ink cartridges are bundled.

Here, the capacity of the package body 800 existing on the upper side of the ink cartridge 1 can be paraphrased as the volume of the gas (capacity of the space) existing between the side of the ink cartridge 1 and the package body 800 when the inside of the package body 800 that packages the ink cartridge 1 is filled with gas. In the same manner, the capacity of the package body 800 existing on the side of the ink cartridge 1 can be paraphrased as the volume of the gas (capacity of the space) existing between the upper side of the ink cartridge 1 and the package body 800 when the inside of the package body 800 that packages the ink cartridge 1 is filled with gas. In the same manner, the capacity of the package body 800 existing on the lower side of the ink cartridge 1 can be paraphrased as the volume of the gas (capacity of the space) existing between the lower side of the ink cartridge 1 and the package body 800 when the inside of the package body 800 packages the ink cartridge 1 with gas.

When the package body 800 that packages the ink cartridge 1 (base metal pigment ink accommodation body) is provided with a second region (a region that is easily broken), the ink cartridge 1 is preferably packaged so that the second region of the package body 800 exists on the upper portion of the ink cartridge 1 (a position that becomes the upside when the ink cartridge 1 is transported). In this case, since the package body 800 is broken from the second region existing on the upper side of the ink cartridge 1, the influence such as the impact added to the color ink cartridge existing on the side of the ink cartridge 1 when the package body 800 is broken can be reduced.

When the atmosphere opening hole 100 of the ink cartridge 1 is sealed with the sealing film 90, and the sealing film 90 is provided with a second region (a region that is easily broken), the ink cartridge 1 is preferably packaged so that the second region of the sealing film 90 exists on the upper portion of the ink cartridge 1 (a position that becomes the top when the ink cartridge 1 is transported). In this case, since the gas discharged from the atmosphere opening hole 100 is promptly collected on the upper side of the ink cartridge 1, it is possible to prevent a side of the package body 800 that packages the ink cartridge 1 from expanding. Accordingly, the influence such as the pressure on the color ink cartridges existing on the side of the ink cartridge 1 can be reduced.

The invention is not limited to the aforementioned embodiment, and various modifications can be made. For example, the invention includes substantially the same configuration (for example, the configuration having the same function, method, and result, or the configuration having the same object and the effect) as the configuration described in the embodiments. Further, the present invention includes the configuration in which unessential portions of the configuration described in the embodiments are substituted. Further, the invention includes the configuration that achieves the same effect with the configuration described in the embodiments and the configuration that achieves the same object. Further, the invention includes the configuration in which a well-known technique is added to the configurations described in the embodiments.

The entire disclosure of Japanese Patent Application No. 2013-181144, filed Sep. 2, 2013 is expressly incorporated by reference herein.

What is claimed is:

1. An ink cartridge that is detachably connected to an ink jet recording apparatus, and is packaged with a first package film, the ink cartridge comprising:

an ink accommodation chamber that accommodates ink containing a base metal pigment;

an atmosphere releasing hole that is connected to the ink accommodation chamber, and communicates with an atmosphere; and a channel that meanders back and forth between the ink accommodation chamber and the atmosphere releasing hole, wherein the first package film is configured to allow a transmission rate of hydrogen gas therethrough to be between equal to or greater than 0.0001 $ml/cm^2 \cdot day \cdot atm$ and equal to or less than 0.01 $ml/cm^2 \cdot day \cdot atm$.

2. The ink cartridge of claim 1, wherein the atmosphere releasing hole is sealed by a sealing film, and wherein when a product of a hydrogen gas transmission rate of the sealing film and a size of a portion of the sealing film that covers the atmosphere releasing hole is set to be A and a product of a hydrogen gas transmission rate of the first package film and a surface area of the first package film is set to be B, a relationship of $A<B$ is satisfied.

3. The ink cartridge of claim 2, wherein a hydrogen gas transmission rate of the hydrogen gas, existing inside the ink accommodation chamber and between the chamber and the atmosphere releasing hole, from the ink cartridge is lower than a hydrogen gas transmission rate of the sealing member, and wherein a water vapor transmission rate existing inside of the ink accommodation chamber and between the chamber and the atmosphere releasing hole, from the ink cartridge is lower than a water vapor transmission rate of the sealing member.

4. The ink accommodation body according to claim 1, wherein the package body includes a first region, and a second region having lower pressure tolerance than the first region.

5. The ink accommodation body according to claim 2, wherein the sealing member includes a first region and a second region having lower pressure tolerance than the first region.

6. A ink accommodation body set comprising:

the ink accommodation body packaged with a package body according to claim 1; and a color ink accommodation body packaged with a package body, wherein the color ink accommodation body includes an ink accommodation portion that accommodates color ink containing a coloring material other than the base metal pigment, and an atmosphere opening portion that is connected to the ink accommodation portion at one end, and communicates with an atmosphere.

7. A ink accommodation body set comprising:

the ink accommodation body packaged with a package body according to claim 2; and a color ink accommodation body packaged with a package body, wherein the color ink accommodation body includes an ink accommodation portion that accommodates color ink containing a color material other than the base metal pigment, and an atmosphere opening portion that is connected to the ink accommodation portion at one end, and communicates with an atmosphere.

8. An ink cartridge set comprising:

cartridge packaged with the first package film of claim 1; and a color ink cartridge packaged with a second package film, wherein the color ink cartridge includes an ink accommodation chamber that accommodates color ink containing a color material other than the base metal pigment, and an atmosphere releasing hole that is connected to the ink accommodation chamber, and communicates with an atmosphere, wherein a hydrogen gas transmission rate of the second package film is lower than a hydrogen gas transmission rate of the first package film.

9. A ink accommodation body set comprising:

the ink accommodation body packaged with a package body according to claim 4; and a color ink accommodation body packaged with a package body, wherein the color ink accommodation body includes an ink accommodation portion that accommodates color ink containing a color material other than the base metal pigment, and an atmosphere opening portion that is connected to the ink accommodation portion at one end, and communicates with an atmosphere.

10. A ink accommodation body set comprising:

the ink accommodation body packaged with a package body according to claim 5; and a color ink accommodation body packaged with a package body, wherein the color ink accommodation body includes an ink accommodation portion that accommodates color ink containing a color material other than the base metal pigment, and an atmosphere opening portion that is connected to the ink accommodation portion at one end, and communicates with an atmosphere.

11. The ink accommodation body set according to claim 6, wherein a hydrogen transmission amount of the package body that packages the color ink accommodation body is lower than a hydrogen transmission amount of a package body that packages the ink accommodation body according to claim 1.

12. The ink accommodation body set according to claim 7, wherein a hydrogen transmission amount of the package body that packages the color ink accommodation body is lower than a hydrogen transmission amount of a package body that packages the ink accommodation body according to claim 1.

13. The ink accommodation body set according to claim 9, wherein a hydrogen transmission amount of the package body that packages the color ink accommodation body is lower than a hydrogen transmission amount of a package body that packages the ink accommodation body according to claim 1.

14. The ink accommodation body set according to claim 10, wherein a hydrogen transmission amount of the package body that packages the color ink accommodation body is lower than a hydrogen transmission amount of a package body that packages the ink accommodation body according to claim 1.

15. A bundling body including the ink accommodation body set according to claim 6 in a housing that disposes and bundles the ink accommodation body accommodated in the package body according to claim 1 is disposed at an end portion of the housing.

* * * * *